US008651241B2

(12) United States Patent
Kocher

(10) Patent No.: US 8,651,241 B2
(45) Date of Patent: Feb. 18, 2014

(54) ELEVATOR SYSTEM WITH TWO ELEVATOR CARS

(75) Inventor: Hans Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 457 days.

(21) Appl. No.: 12/809,771

(22) PCT Filed: Dec. 11, 2008

(86) PCT No.: PCT/EP2008/067285

§ 371 (c)(1),
(2), (4) Date: Sep. 30, 2010

(87) PCT Pub. No.: WO2009/080538

PCT Pub. Date: Jul. 2, 2009

(65) Prior Publication Data

US 2011/0005867 A1 Jan. 13, 2011

(30) Foreign Application Priority Data

Dec. 21, 2007 (EP) ..... 07123986

(51) Int. Cl.
*B66B 9/00* (2006.01)
*B66B 11/08* (2006.01)

(52) U.S. Cl.
USPC ..... 187/249; 187/266

(58) Field of Classification Search
USPC ..... 187/249, 266
See application file for complete search history.

(56) References Cited

U.S. PATENT DOCUMENTS

| | | | | | |
|---|---|---|---|---|---|
| 12,640 | A * | 4/1855 | Murtaugh | ..... | 187/251 |
| 30,831 | A * | 12/1860 | Murtaugh | ..... | 187/251 |
| 353,458 | A * | 11/1886 | Murtaugh | ..... | 187/249 |
| 1,625,084 | A * | 4/1927 | Hymans | ..... | 187/266 |
| 1,837,643 | A | 12/1931 | Anderson | | |
| 5,526,901 | A | 6/1996 | Salmon | | |
| 6,860,367 | B1 * | 3/2005 | Ericson | ..... | 187/265 |
| 7,032,716 | B2 * | 4/2006 | Meyle et al. | ..... | 187/382 |
| 7,857,103 | B2 * | 12/2010 | Kocher | ..... | 187/249 |
| 2004/0129502 | A1 * | 7/2004 | Hikita | ..... | 187/383 |
| 2008/0149428 | A1 * | 6/2008 | Kocher et al. | ..... | 187/249 |
| 2011/0088980 | A1 * | 4/2011 | Husmann | ..... | 187/249 |
| 2012/0006626 | A1 * | 1/2012 | Adifon | ..... | 187/249 |
| 2012/0006627 | A1 * | 1/2012 | Carparelli et al. | ..... | 187/266 |

FOREIGN PATENT DOCUMENTS

| | | | |
|---|---|---|---|
| EP | 1329412 | A1 | 7/2003 |
| JP | 2001335259 | A | 12/2001 |
| WO | 2006065241 | A2 | 6/2006 |

* cited by examiner

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

An elevator system has two elevator cars arranged one over the other, but that can travel independently of each other. Both elevator cars are suspended on suspension and traction mechanisms and each is coupled to a separate counterweight. Both elevator cars have a lower cable, wherein the two lower cables are tensioned by separate tension devices. The lower cable of the first, lower elevator car is fastened to the first elevator car and the first counterweight, The lower cable of the second, upper elevator car is guided at the second elevator car and at least one of the two lower cable ends thereof is secured by a weighted body secured in place with play and/or free-floating.

11 Claims, 6 Drawing Sheets

ELEVATOR SYSTEM WITH TWO ELEVATOR CARS

FIELD OF THE INVENTION

The invention relates to an elevator system with two elevator cars, which are movable along a common travel path independently of one another.

BACKGROUND OF THE INVENTION

In order to improve the transport capacity of an elevator system with small demand on space two elevator cars are arranged in the same elevator shaft. The two elevator cars are movable independently of one another along a common guide path usable by both.

Such elevator systems with two or optionally more than two elevator cars in the same elevator shaft are primarily provided for high buildings. The merits of these double car elevators are relevant particularly when the individual elevator cars can circulate at a comparatively high speed.

Even in conventional elevator systems with only one elevator car, in the case of elevator systems of that kind with several elevator cars tensioning devices with lower cables are provided when travel speeds above a certain limit speed, for example above approximately 2.5 m/s are envisaged. The tensioning device for the lower cables preferably acts in a blocking manner in order to prevent the counterweight from jumping when the car safety brakes come into action, for which purpose the counterweight is retarded by a reaction force introduced into the elevator shaft.

Due to the vertically fluctuating arrangement of two elevator cars it is difficult to accommodate drive elements, supporting elements and traction elements in the form of flexible flat belts and/or cables as well as roller arrangements for drive, guidance and deflection of the supporting elements and traction elements in the common elevator shaft. As further flexible elements the lower cables must also be arranged together with the rollers required for the deflection and guidance thereof. A further requirement is to realize a suitable introduction of the forces into the elevator cars.

WO 2006/065241 discloses an elevator system of that kind with two elevator cars which can be moved independently of one another along a travel path able to be utilized by both elevator cars. The two elevator cars are suspended at individual supporting and traction means and have individual counterweights. The upper elevator car has a central 1:1 suspension and the lower elevator car has a symmetrical 1:2 suspension and deflecting rollers for guidance or directing the supporting and traction means. A satisfactory solution for the mounting, deflecting and guidance of lower cable arrangements is not described.

SUMMARY OF THE INVENTION

It is now an object of the invention to propose a faultlessly functioning elevator system, which can be operated with all requisite safety, with several elevator cars.

The new elevator system thus comprises a first elevator car and a second elevator car, wherein the first elevator car is always arranged below the second elevator car. The two elevator cars are movable along a common travel path and are drivable substantially independently of one another. The first, lower elevator car has a supporting and traction means, at which it has 1:2 suspension and which has two regions or ends which are guided by means of a first deflecting roller arrangement. The deflecting roller arrangement comprises two deflecting rollers mounted at the lower region of the first elevator car. In a preferred arrangement the forces are introduced into the elevator car substantially symmetrically, preferably centrally symmetrically. A counterweight associated with the lower elevator car is coupled therewith. In addition, a lower cable arrangement with a lower cable is provided, which is mounted by one end thereof on the first elevator car preferably at least approximately centrally and has 1:1 suspension. The lower cable is tensioned by means of a first lower-cable tensioning device. The lower cable is fastened by its other end to the first counterweight.

The second upper elevator car similarly has a supporting and traction means, at which it has, preferably at least approximately centrally, 1:1 suspension. It is coupled with a second counterweight associated therewith. Also provided is a lower cable having two lower cable ends which are mounted at the upper elevator car. The lower cable ends have, at least approximately center-symmetrically or diagonally, 1:2 suspension by means of a first deflecting roller for the first lower cable end and a second deflecting roller for the second lower cable end. The lower cable is tensioned by means of a second lower-cable tensioning device. The lower cable ends are fixed in that the first lower cable end is fastened to a first fastening point and the second lower cable end is fastened to a second fastening point, wherein at least one of the fastening points is disposed at a weighting body which is suspended at the lower cable end connected therewith or which is so arranged and—optionally elastically—fastened or held that it can move vertically relative to the base of the elevator shaft at least through a certain degree of play.

The deflecting rollers for the two ends of the supporting and traction means of the lower elevator car on the one hand and the deflecting rollers for the two cable ends of the upper elevator car on the other hand are preferably arranged at different horizontal spacings and at least approximately point-symmetrically diagonally relative to one another.

Preferably, lower cable arrangements with tensioning devices for each elevator car are present. In this connection, the numerous flexible elements are preferably so mounted that sufficient spacing between adjacent flexible elements is always present so as to avoid mutual impairments. With particular preference symmetrical and/or central introduction of the forces of the supporting and traction means into the elevator cars is also present and equally the forces of the lower cable arrangements are preferably also introduced symmetrically or centrally.

In a preferred embodiment the new elevator system is so designed that the lower-cable tensioning device of the lower cable of the first elevator car is arranged below the supporting and traction means of the first elevator car, i.e. the fastening point of the lower cable at the first elevator car lies below the supporting and traction means of the first elevator car, for example on a yoke which is fastened to the first elevator car.

The lower-cable tensioning device for the lower cable of the lower elevator car has a roller arrangement which is fastened in stationary position or with small play to a wall of the elevator shaft, Alternatively, this lower-cable tensioning device can comprise a deflecting and weighting arrangement which is suspended as a block at the lower cable.

The lower cable arrangement of the upper elevator car can be conceived in such a manner that the fastening points of the two lower cable ends are stationary and that the lower-cable tensioning device comprises a roller and weighting arrangement which is suspended at the lower cable as a block.

Alternatively, the fastening point of one of the lower cable ends of the upper elevator car can be arranged at a weighting body freely hanging in the elevator shaft and the fastening point of the other lower cable end can then be fastened in a stationary position at a boundary of the elevator shaft, for example at the base of the elevator shaft.

In a particularly preferred development of the new elevator system it can be provided that at least the tensioning device of one of the lower cables of the first, lower elevator car or of the second, upper elevator car comprises a braking and/or blocking device, preferably with a hydraulic cylinder and a pressure blocking valve, in order to brake the lower cable or keep it stationary when one of the two elevator cars approaches a speed exceeding a predeterminable maximum speed.

DESCRIPTION OF THE DRAWINGS

Further details and advantages of the invention are described in detail in the following by way of an exemplifying embodiment and with reference to the drawing, in which.

DESCRIPTION OF PREFERRED EMBODIMENTS

Figure 1A:
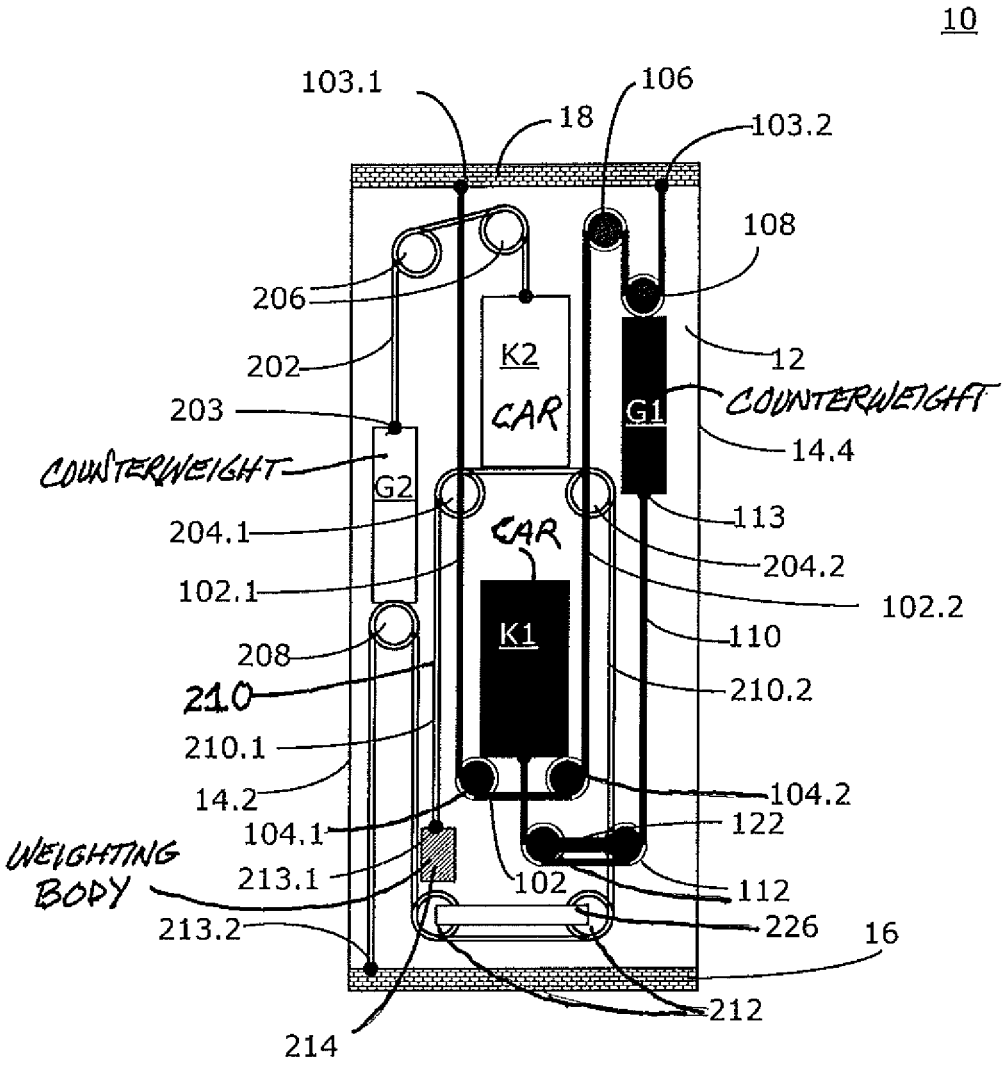
FIG. 1A shows a first exemplifying embodiment of the elevator system according to the invention in simplified schematic illustration from the side.

Constructional elements which are the same and similar with substantially the same effect are provided in FIGS. 1A, 1B, 2A, 2B, 3A and 3B with the same reference numerals. It is to be noted that the parts, which are denoted as ends of supporting and traction means and as lower cable ends, of flexible elements have no fixed dimensions, but can have different lengths depending on the respective position of the elevator cars.

FIG. 1A shows an elevator system 10 according to the invention. The elevator system 10 comprises a first elevator car K1 arranged at the bottom and a second elevator car K2 arranged at the top. The two elevator cars K1 and K2 are movable upwardly and downwardly independently of one another along a travel path usable by both elevator cars K1 and K2. The travel path together with lateral guides is disposed in an elevator shaft 12, which is bounded by four side walls 14.1, 14.2, 14.3 and 14.4, a shaft pit or a base 16 and a roof 18.

The first, lower elevator car K1 is suspended at or in a supporting and traction means 102 substantially point-symmetrically or with diagonally opposite force introduction zones and in the ratio 1:2. The supporting and traction means 102 of the lower elevator car K1 comprises a first end 102.1 and a second end 102.2. The suspension of the first, lower elevator car K1 takes place at two opposite car sides and, as seen from above and shown in FIG. 1B, at least approximately center-symmetrically. The first end 102.1 of the supporting and traction element 102 is guided by way of a first deflecting roller 104.1, which is mounted at the bottom of the first elevator car K1, to a stationary fastening point 103.1 at the roof 18 of the elevator shaft 12. The second end 102.2 of the supporting and traction element 102 is guided by way of a second deflecting roller 104.2, which is similarly mounted at the bottom at the first elevator car K1, via a roller arrangement 106 and a further roller arrangement 108—which is arranged at the top at the first counterweight G1—to a further stationary fastening point 103.2 at the roof 18 of the elevator shaft 12, The second, upper elevator car K2 is suspended centrally in a 1:1 suspension at a second supporting and traction means 202. The supporting and traction means 202 is guided by way of a roller arrangement 206 to a fastening point 203, which is arranged at the top at the second counterweight G2, and fastened there.

The first, lower elevator car K1 has a first cable tension compensation. This first cable tension compensation comprises a first lower cable 110. The lower cable 110 is mounted at least approximately centrally at the base of the first elevator car K1. The lower cable 110 is tensioned by way of a lower-cable tensioning device. This lower-cable tensioning device comprises a lower-cable roller arrangement 122 with two lower-cable rollers 112 by way of which the lower cable 110 is guided to a fastening point 113 arranged at the bottom at the first counterweight G1. The said lower-cable rollers 112 are preferably in the form of a roller and weighting arrangement 122, which is freely suspended as a block at the lower cable 110. The terms "lower-cable roller arrangement", "roller and weighting arrangement" and "deflecting and tensioning device" are used herein interchangeably.

In an optional embodiment the said lower-cable rollers are connected in a stationary position, for example with a wall or base of the elevator shaft 12. They can also be retained, in a manner which is not illustrated, to be adjustable, particularly in a vertical direction, through a small height or a small play and possibly resiliently.

The second, upper elevator car K2 has a second cable tension compensation. The second cable tension compensation comprises a second lower cable 210 with two lower cable ends 210.1 and 210.2. The lower cable ends 210.1 and 210.2 are led laterally, at opposite sides of the second elevator car K2 and at least approximately center-symmetrically or diagonally, to the second elevator car K2. Moreover, a second deflecting roller arrangement with a deflecting roller 204.1 for the lower cable end 210.1 and with a further deflecting roller 204.2 for the other lower cable end 210.2 is mounted on the second elevator car K2.

One lower cable end 210.1 of the lower cable 210 of the second elevator car K2 is led by the deflecting roller 204.1 to a fastening point 213.1 at a weighting body 214, which is disposed—fastened to the lower cable end 210.1—in the elevator shaft 12. This weighting body 214 can be fastened to be freely floating or also adjustable in height through a small distance, in the manner of a play, at one of the boundaries of the elevator shaft 12, particularly at the base 16 and in a given case resiliently.

The other lower cable end 210.2 of the lower cable arrangement of the second elevator car K2 is guided by the deflecting roller 204.2, a lower-cable roller arrangement 226 with two rollers 212, which are mounted in stationary position at a boundary 16 of the elevator car 12, as well as a roller 208, which is arranged at the bottom at the second counterweight G1, to a fastening point 213.2, where the lower cable end 210.2 is held in a stationary position.

The deflecting rollers 104.1, 104.2 at the first, lower elevator car K1 and the deflecting rollers 204.1, 204.2 at the second, upper elevator car K2 are so arranged that the ends of the supporting and traction means 102 of the first elevator car K1 have a smaller horizontal spacing from the elevator cars K1 and K2 than the lower cable ends of the lower cable 210, which are arranged on the same side of the elevator shaft 12. In a particularly preferred embodiment the deflecting rollers 104.1, 104.2 for the supporting and traction means 102 of the lower elevator car K1 and the deflecting rollers 204.1, 204.2 for the lower cable 210 of the upper elevator car K2 are so arranged that the longitudinal axes of the guided sections of the supporting and traction means 102 and of the lower cable 210 stand at least approximately center-symmetrically with respect to the elevator cars K1, K2 and diagonally cross over. In general, the arrangement of all rollers and fastening points and thus the guidance or the course of the supporting and traction means as well as the lower cables or the lower cable ends is such that the forces in any position of the elevator cars act at least approximately center-symmetrically on the elevator cars and that also in any position of the elevator cars sufficient spacing between the supporting and traction means and the lower cable or the lower cable ends is present.

Figure 1B:
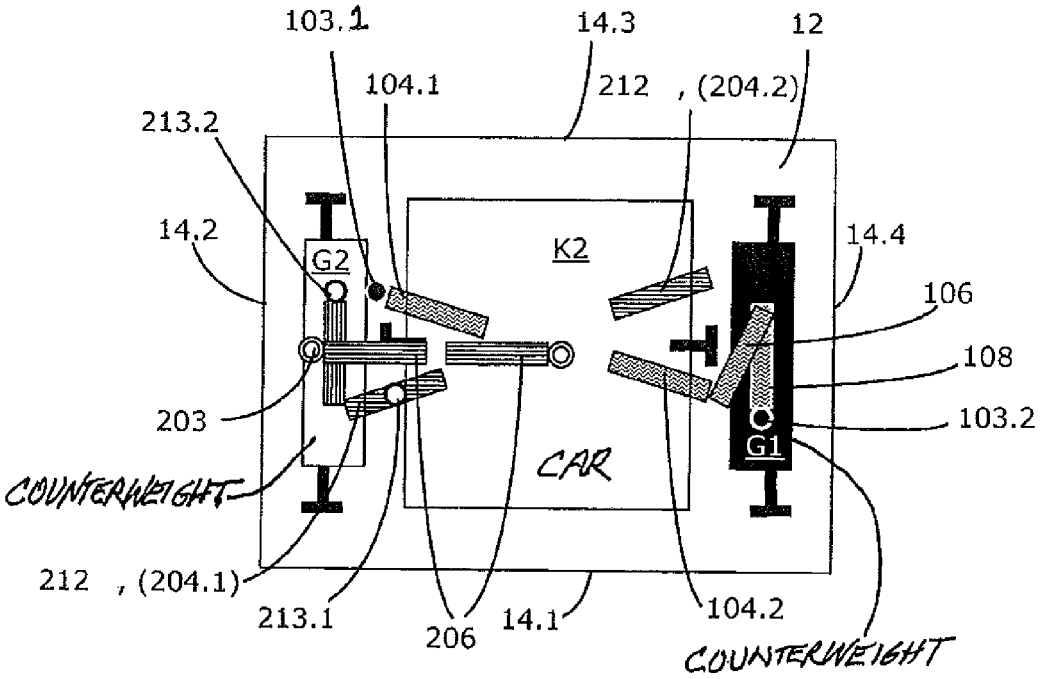
FIG. 1B shows the exemplifying embodiment, which is illustrated in FIG. 1A, of the invention in a scale enlarged relative to FIG. 1A, from above.
Figure 2A:
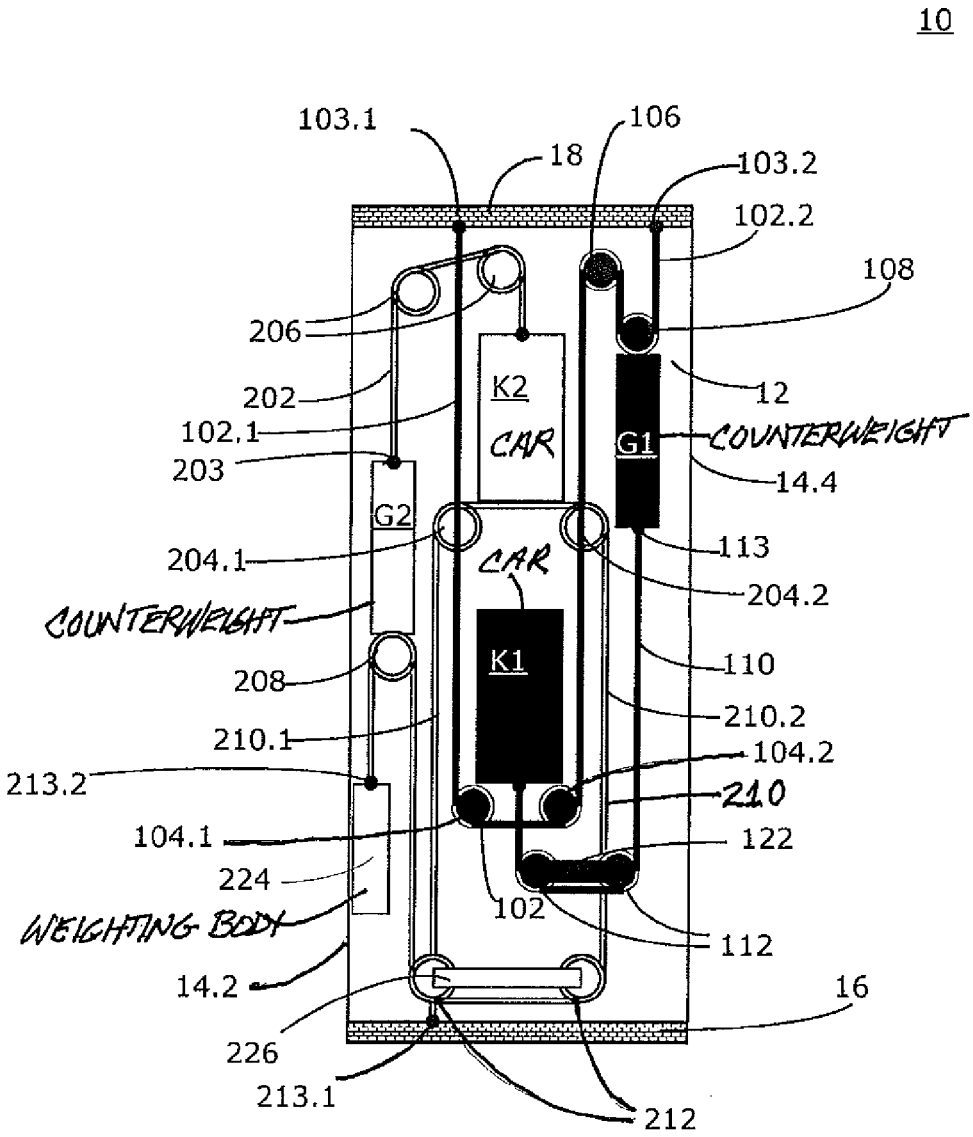
FIG. 2A shows a second exemplifying embodiment of the elevator system according to the invention in simplified illustration the same as FIG. 1A.
Figure 2B:
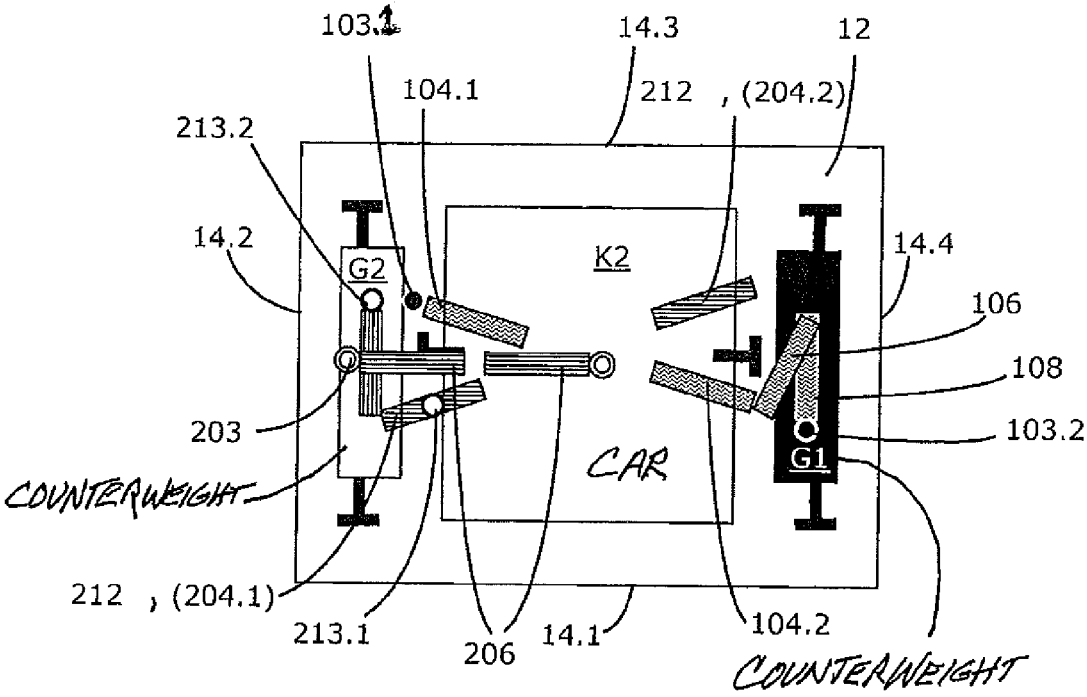
FIG. 2B shows the exemplifying embodiment, which is illustrated in FIG. 2A, of the invention in the same illustration as FIG. 1B.

FIG. 2A and FIG. 2B show a second exemplifying embodiment of the elevator installation 10 according to the invention. The arrangement of the first elevator car K1 with the counterweight G1, the associated supporting and traction means 102 or the ends 102.1 and 102.2 thereof, the deflecting rollers 104.1, 104.2, the roller arrangements 106 and 108, the fastening points 103.1 and 103.2 and the lower cable 110 is the same as in the exemplifying embodiment which is shown in FIGS. 1A and The arrangement of the elevator car K2 with the counterweight G2, the associated supporting and traction element 202, the roller arrangements 206 and the fastening point 203 at the counterweight G2 is the same as in the exemplifying embodiment shown in FIGS. 1A and 1B.

The exemplifying embodiment of FIGS. 2A and 2B thus differs from the exemplifying embodiment of FIGS. 1A and 1B merely by the construction of the lower-cable tensioning devices for the lower cable 210.

As similarly shown in FIGS. 2A and 2B, the first lower cable end 210.1 of the second elevator car K2 runs from its suspension point at the second elevator car K2 via the first deflecting roller 204.1 to the fastening point 213.1, which is fastened at the base 16 of the elevator shaft 12. This fastening point 213.1 preferably lies below a lower-cable roller arrangement 226 with two rollers 212 at a yoke, which is fixed to the base 16 of the lift shaft 12. The second lower cable end 210.2 of the second elevator car K2 runs from its suspension point at the elevator car K2 via the second deflecting roller 204.2 to a lower-cable roller arrangement 226 with two rollers 212, which are held in stationary position at a boundary 16 of the elevator shaft 12, from there to the deflecting roller 208 at the lower end of the second counterweight G2 and finally to a further fastening point 213.2 at a weighting body 224, which hangs freely at the second lower cable end 210.2.

Figure 3A:
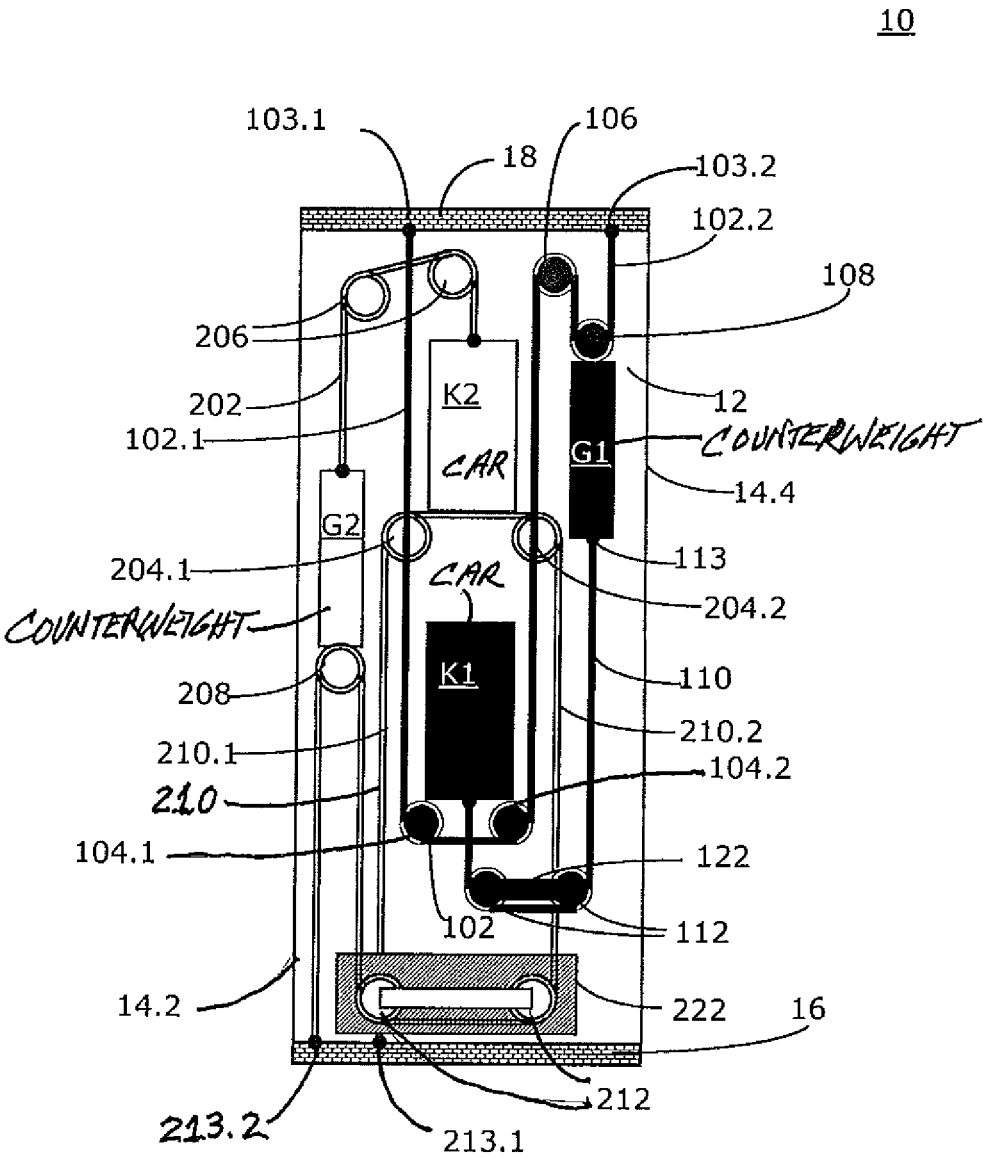
FIG. 3A shows a third exemplifying embodiment of the elevator system according to the invention in simplified illustration the same as FIG. 1A.
Figure 3B:
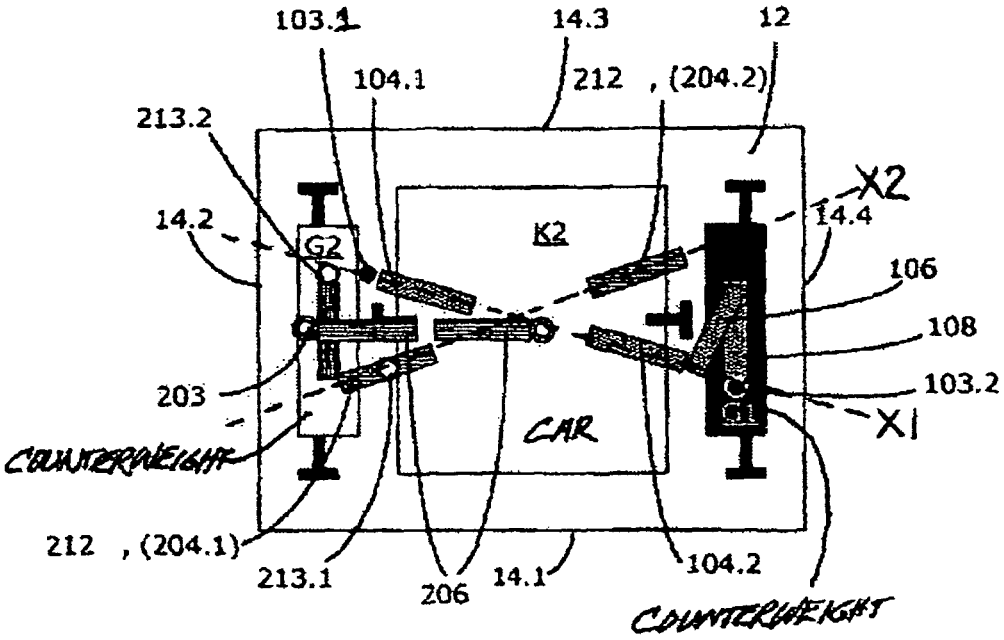
FIG. 3B shows the exemplifying embodiment, which is illustrated in FIG. 3A, of the invention in the same illustration as FIG. 1B, and further shows intersecting planes X1 and X2 along which deflecting rollers are oriented.

FIGS. 3A and 3B show a third exemplifying embodiment of the elevator system 10 according to the invention. The arrangement of the supporting and traction means 102, 202 of the two elevator cars K1, K2 as well as the arrangement of the lower cable 110 of the first elevator car K1 correspond with the respective arrangements of the second exemplifying embodiment from FIGS. 2A and 2B. The third exemplifying embodiment thus basically differs from the second exemplifying embodiment only in the arrangement of the lower cable 210 of the second elevator car.

As similarly shown in FIGS. 2A and 2B, the first lower cable end 210.1 of the second elevator car K2 runs from its suspension point at the second elevator car K2 via the first deflecting roller 204.1 to the fastening point 213.1, which is fastened at the base 16 of the elevator shaft 12. This fastening point 213.1 preferably lies below a roller and weighting arrangement 222 at a yoke, which is fixed at the base 16 of the elevator shaft 12. The second lower cable end 210.2 of the second elevator car K2 runs from its suspension point at the second elevator car K2 via the second deflecting roller 204.2 to a roller and weighting arrangement 222, which freely hangs, at the second lower cable end 210.2, as a block in the elevator shaft 12. In a preferred embodiment this deflecting and tensioning device 222 is held in a stationary position with a vertical play. From the deflecting and tensioning device 222 the second lower cable end 210.2 is further led to the deflecting roller 208 at the lower end of the second counterweight G2 and finally to a further fastening point 213.2. This fastening point 213.2 is disposed at the base 16 of the elevator shaft 12.

The lower-cable tensioning device of the lower cables 110, 210 of the lower and upper elevator cars K1, K2 preferably has a braking and/or blocking device, which is not illustrated, but conventional. If now a lower cable 110, 210 has such a device, a roller and weighting arrangement 122, 222, 226 or a weighting body 214, 224 is in normal operation freely vertically displaceable along a guide. The blocking device is brought into action from a speed of an elevator car K1, K2 above a limit speed of, for example 3.5 m/s. If, now, an elevator car K1, K2 is moved at such a high speed and then is caught, an associated roller and weighting arrangement 122, 222, 226 or a weighting body 214, 224 threatens to jump. In order to preclude such jumping, the vertically guided roller and weighting arrangement 122, 222, 226 and a weighting body 214, 224 are blocked by the braking and/or blocking device relative to the base 16 of the elevator shaft 12. For this purpose the blocking device is constructed as, for example, a hydraulic cylinder with a pressure blocking valve, which is activated on catching of an associated elevator car K1, K2.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having a first, lower elevator car and a second upper elevator car, which cars are movable along a common travel path, comprising:

a first supporting and traction means supporting the first elevator car with a 1:2 suspension and which has two ends each guided by a respective deflecting roller;

a first counterweight coupled to said first supporting and traction means;

a first lower cable coupled to the first elevator car wherein said first lower cable is connected with the first elevator car in a 1:1 suspension and is tensioned by a first tensioning device, said first lower cable being mounted by one first lower cable end on the first elevator car and fastened by another first lower cable end to said first counterweight;

a second supporting and traction means supporting the second elevator car;

a second counterweight coupled to said second supporting and traction means; and a second lower cable coupled to the second elevator car, wherein said second supporting and traction means supports the second elevator car with a 1:1 suspension and is suspended at least approximately centrally at the second elevator car and said second lower cable is connected in a 1:2 suspension with the second elevator car and is tensioned by a second tensioning device, said second lower cable having two lower cable ends each guided by a respective lower cable-deflecting roller that is disposed at least partly outside a lateral width of said second elevator car and at least partly outside a lateral width of said first elevator car, wherein a first of said second lower cable ends is fastened at a first fastening point and a second of said second lower cable ends is fastened at a second fastening point, wherein said deflecting rollers for said first supporting and traction means and said deflecting rollers for said second lower cable are arranged at different horizontal spacings and are at least approximately centrally symmetrically diagonally with respect to one another, wherein a first plane along which said deflecting rollers for said first supporting and traction means are aligned is at an angle to a second plane along which said deflecting rollers for said second supporting and tractions means are aligned, a line parallel and approximately central to the common travel path defined by an intersection of said first plane and said second plane, said deflecting rollers for said first supporting and traction means spaced apart substantially evenly from the line, and said deflecting rollers for said second supporting and traction means spaced apart substantially evenly from the line.

2. The elevator system according to claim 1 including a wherein said first tensioning device for said first lower cable is arranged below said first supporting and traction means.

3. The elevator system according to claim 1 wherein said first tensioning device has a lower-cable roller arrangement fastened in stationary position or with slight play at a boundary wall of an elevator shaft.

4. The elevator system according to claim 1 wherein said first tensioning device has a roller and weighting arrangement freely suspended as a block at said lower cable.

5. The elevator system according to claim 1 wherein at least one of said first and second fastening points is a stationary position at a base of an elevator shaft.

6. The elevator system according to claim 1 wherein one of said first and second fastening points is at a weighting body which freely hangs at said lower cable end or is held in a stationary position with vertical play.

7. The elevator system according to claim 1 wherein said first fastening point and said second fastening point each are fixed in a stationary position at a base of an elevator shaft.

8. The elevator system according to claim 7 wherein said second tensioning device has a roller and weighting arrangement held in a stationary position or with small play at a boundary of the elevator shaft.

9. The elevator system according to claim 7 wherein said second tensioning device has a roller and weighting arrangement freely suspended as a block in the elevator shaft at said second lower cable end.

10. An elevator system having a first, lower elevator car and a second upper elevator car, which cars are movable along a common travel path, comprising:

a first supporting and traction means supporting the first elevator car with a 1:2 suspension and which has two ends each guided by a respective deflecting roller at a bottom of said first elevator car;

a first counterweight coupled to said first supporting and traction means;

a first lower cable connected between the first elevator car and said first counterweight wherein said first lower cable is connected with the first elevator car in a 1:1 suspension and is tensioned by a first tensioning device, said first lower cable being mounted by one first lower cable end on the first elevator car and fastened by another first lower cable end to said first counterweight;

a second supporting and traction means supporting the second elevator car with a 1:1 suspension;

a second counterweight coupled to said second supporting and traction means; and a second lower cable which has two ends each guided by a respective deflecting roller at a bottom of said second elevator car, one of said second lower cable ends being fastened at a base of an elevator shaft at a first fastening point wherein said second supporting and traction means supports the second elevator car with a 1:1 suspension and is suspended at least approximately centrally at the second elevator car and said second lower cable is connected in a 1:2 suspension with the second elevator car and is tensioned by a second tensioning device, said second lower cable having two lower cable ends each guided by a respective lower cable-deflecting roller that is disposed at least partly outside a lateral width of said second elevator car and at least partly outside a lateral width of said first elevator car, wherein another of said second lower cable ends is fastened at a second fastening point, wherein said deflecting rollers for said first supporting and traction means and said deflecting rollers for said second lower cable are arranged at different horizontal spacings and are at least approximately centrally symmetrically diagonally with respect to one another, wherein a first plane along which said deflecting rollers for said first supporting and traction means are aligned is at an angle to a second plane along which said deflecting rollers for said second supporting and tractions means are aligned, a line parallel and approximately central to the common travel path defined by an intersection of said first plane and said second plane, said deflecting rollers for said first supporting and traction means spaced apart substantially evenly from the line, and said deflecting rollers for said second supporting and traction means spaced apart substantially evenly from the line.

11. The elevator system according to claim 10 wherein said another of said second lower cable ends is fastened at the base of the elevator shaft or to a weighting body.

* * * * *